US005430347A

United States Patent [19]

Kane et al.

[11] Patent Number: 5,430,347

[45] Date of Patent: Jul. 4, 1995

[54] FIELD EMISSION DEVICE WITH INTEGRALLY FORMED ELECTROSTATIC LENS

[75] Inventors: Robert C. Kane, Woodstock; Norman W. Parker, Wheaton, both of Ill.

[73] Assignee: Motorola, Inc., Schaumburg, Ill.

[21] Appl. No.: 93,134

[22] Filed: Jul. 16, 1993

Related U.S. Application Data

[63] Continuation of Ser. No. 800,810, Nov. 29, 1991, abandoned.

[51] Int. Cl.[6] ..... H01J 1/62; H01J 21/16

[52] U.S. Cl. ..... 313/309; 313/336; 313/422

[58] Field of Search ..... 313/309, 308, 336, 495, 313/422

[56] References Cited

U.S. PATENT DOCUMENTS

| | | | |
|---|---|---|---|
| 4,857,799 | 8/1989 | Spindt et al. | 313/495 |
| 4,940,916 | 7/1990 | Borel et al. | 313/336 X |
| 4,983,878 | 1/1991 | Lee et al. | 313/309 X |
| 5,012,153 | 4/1991 | Atkinson et al. | 313/309 X |

FOREIGN PATENT DOCUMENTS

| | | |
|---|---|---|
| 0349425 | 1/1990 | European Pat. Off. . |
| 92/09095 | 5/1992 | WIPO . |

OTHER PUBLICATIONS

"Field-Emitter Arrays for Vacuum Microelectronics" by Spindt et al, *IEEE Transactions on Electron Devices*, vol. 38, No. 10, Oct. 1991, pp. 2355–2363.

*Primary Examiner*—Sandra L. O'Shea

*Attorney, Agent, or Firm*—Eugene A. Parsons

[57] ABSTRACT

A FED including an integrally formed electrostatic lens with an aperture having a diameter which is dis-similar from an aperture of the FED gate to effect a reduction in electron beam cross-section. By forming the FED with an electrostatic lens aperture of increased diameter relative to the diameter of the gate aperture a reduced sensitivity with respect to lens thickness and location is realized as is a relaxation of electrostatic lens fabrication constraints. Image display devices employing such integrally formed electrostatic lens systems may be provided wherein pixel cross-sections as small as two microns are realized.

14 Claims, 11 Drawing Sheets

-PRIOR ART-

-PRIOR ART-

-PRIOR ART-

-PRIOR ART-

FIELD EMISSION DEVICE WITH INTEGRALLY FORMED ELECTROSTATIC LENS

This application is a continuation of prior application Ser. No. 07/800,810, filed Nov. 29, 1991 now abandoned.

FIELD OF THE INVENTION

The present invention relates generally to cold-cathode field emission devices and more particularly to a method for realizing an electrostatic lens as an integral part of a field emission device.

BACKGROUND OF THE INVENTION

Field emission devices (FEDs) are known in the art and may be realized using a variety of methods some of which require complex materials deposition techniques and others which require process steps such as anisotropic etch steps. Typically FEDs are comprised of an electron emitter, a gate extraction electrode, and an anode although two element structures comprised of only an electron emitter and anode are known. In a customary application of an FED a suitable potential is applied to at least the gate extraction electrode so as to induce an electric field of suitable magnitude and polarity in a region at/near the electron emitter such that electrons may tunnel through a reduced surface potential barrier of finite extent with increased probability. Emitted electrons, those which have escaped the surface of the electron emitter into free-space, are generally preferentially collected at the device anode. For some applications such as, for example, displays it is desirable to provide an electrostatic focusing lens which alters the trajectory of emitted electrons in a manner to improve display image resolution. However, existing electrostatic lens structures do not provide for electron beam trajectory modification which will yield an electron beam profile suitable for many applications.

Accordingly, there is a need for a field emission device employing an electrostatic lens and/or a method for forming a field emission device with an integral electrostatic lens which overcomes at least some of these shortcomings of the prior art.

SUMMARY OF THE INVENTION

This need and others are substantially met through provision of a field emission device comprising an electron emitter for emitting electrons, a gate defining an aperture therethrough, with a first size, through which emitted electrons pass, an anode positioned to collect emitted electrons passing through the gate aperture, and an electrostatic lens positioned between the gate and the anode and defining an aperture therethrough for the passage of emitted electrons, the aperture of the electrostatic lens having a second size which is dis-similar to the first size of the aperture of the gate.

This need and others are further met by providing a method of forming a field emission device with integral electrostatic lens including the steps of providing a plurality of layers of material including a supporting substrate having a surface, a plurality of insulating layers, a plurality of conductive/semiconductive layers, and a selectively patterned etch mask layer all proximally disposed with respect to each other in a fixed relationship to form a single multi-layered structure, performing a first directed etch to selectively remove material from some of the layers of material of the multi-layered structure in a region substantially corresponding to a pattern of the selectively patterned etch mask, depositing a substantially conformal insulator layer on the etched structure, performing a second directed etch to remove some of the conformal insulator layer whereby a sidewall is formed, performing a third directed etch to remove some of the material of some other of the layers of material of the multi-layered structure such that at least a part of the surface of the supporting substrate is exposed, removing substantially all of the remaining conformally deposited insulator layer, which layer formed the sidewall, and forming an electron emitter substantially disposed on the exposed part of the surface of the supporting substrate.

In one embodiment of an FED with integrally formed electrostatic lens of the present invention an electrostatic lens is employed to provide modification to the trajectories of emitted electrons forming an electron beam such that the electron beam cross-section at 1000 microns distance from the electron emitter is less than approximately 10 microns and at 3000 microns distance from the electron emitter is less than approximately 20 microns.

In another embodiment of an FED in accordance with the present invention a plurality of electrostatic lenses is provided wherein each of the plurality of lenses define an aperture having a preferred diameter, dis-similar to that of others of the plurality of electrostatic lenses, and wherein at least some of the diameters of the lense apertures are dis-similar from the diameter of an aperture in the gate.

In yet another embodiment of an FED with an integrally formed electrostatic lens in accordance with the present invention an image display device is realized wherein the electrostatic lens system provides for an electron beam cross-section of reduced size such that an image pixel size of from approximately 2 to 25 microns may be employed.

DETAILED DESCRIPTION OF THE PREFERRED EMBODIMENTS

As is known in the prior art electrons are emitted from a cold-cathode field emitter with non-uniform velocity in the sense that each constituent of the total electron flux does not necessarily possess an identical radial velocity component (with respect to the normal axis of the emitter structure). This non-uniform radial component of the velocity is primarily due to the fact that emitted electrons are accelerated from the emitter surface through a very strong electric field which is necessarily perpendicular (normal) to the emitter surface. Since the electric field in the region of a field emission electron emitter is substantially normal to the surface of the electron emitter, emitted electrons will assume trajectories which are substantially parallel to the direction of the electric field.

Figure 1A:
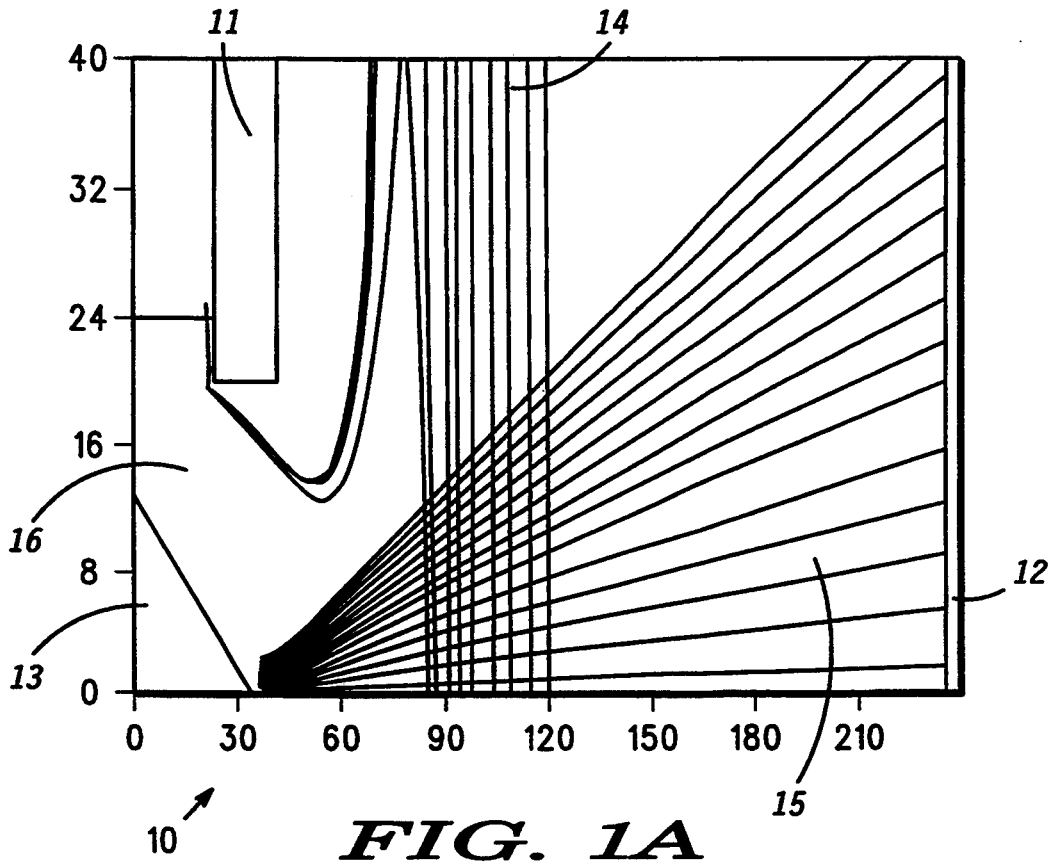
FIG. 1A is a computer model representation of a field emission device as is known in the prior art and further depicting emitted electron trajectories.

Referring now to FIG. 1A there is depicted a computer model representation of one half of a side elevational view of a prior art FED 10 wherein an electron emitter 13 is proximally disposed with respect to an accelerating electrode (gate) 11 having a first diameter which defines an aperture 16 through which electrons emitted by electron emitter 13 may pass. Dimensions are indicated in FIG. 1A as mesh units along an ordinate and abscissa wherein a mesh unit, for this particular representation, is 0.02 μm. By applying a suitable externally provided potential (not shown) to gate 11, as is known and well described in the art, an enhanced electric field will be induced at/near electron emitter 13. When electron emitter 13 is operably coupled to an externally provided reference potential (not shown) such as, for example a ground reference, electrons are emitted from electron emitter 13 into a free-space region immediately adjacent to the surface of electron emitter 13. An anode 12, the purpose of which is to collect at least some of any emitted electrons, is distally disposed with respect to electron emitter 13. An electric field which exists in the free-space region is represented by equipotential lines 14. Electrons which are emitted from the surface of electron emitter 13 travel in accordance with the requirements imposed by any electric field through which an electron passes and, for the case of the instant device, assume electron trajectories 15 as depicted. For FED 10 it is evident that, as the electrons move away from electron emitter 13 toward anode 12, the cross-section of the electron beam increases.

Alternatively, and as will be utilized subsequently, an anode may be disposed more/less distally with respect to the electron emitter and maintain substantially identical device operating characteristics if the voltage on the anode is correspondingly varied such that the electric field in the free-space region remains unchanged.

Figure 1B:
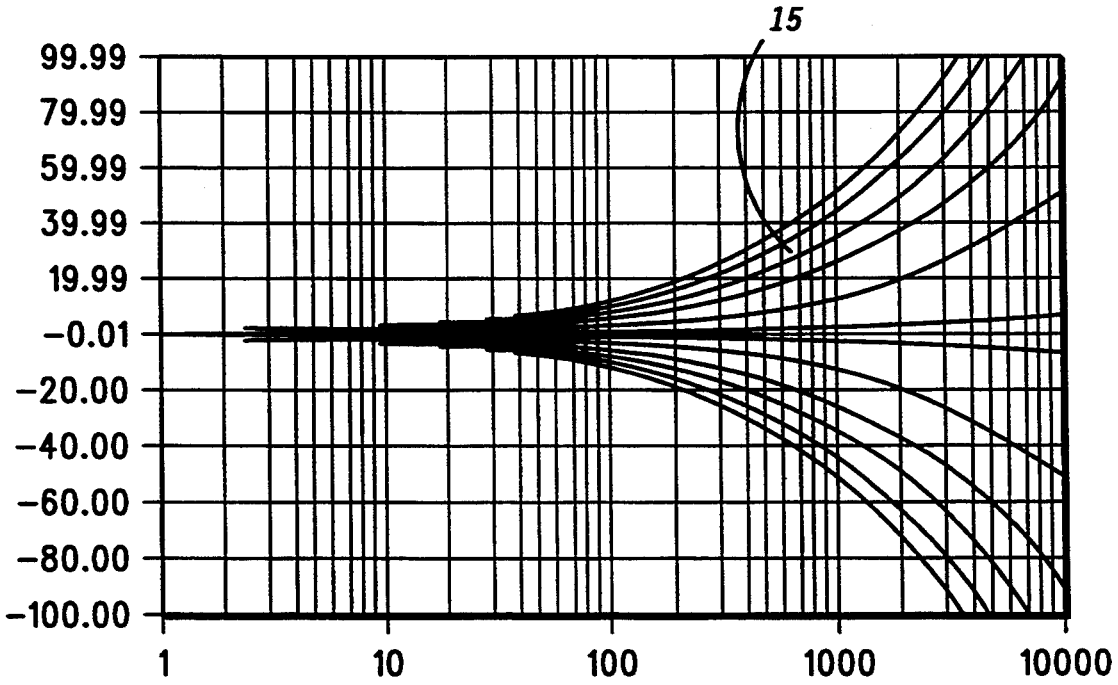
FIG. 1B is a depiction of an extension of the electron trajectories first described in FIG. 1A.

FIG. 1B is a computer model representation of an extended electron path which depicts electron trajectories 15 of FED 10 through a transit distance of 0.01 meter wherein the electron trajectories 15 originate at the location depicted as 1.0 (ordinate) and -0.01 (abscissa). Dimensions, located along the ordinate and abscissa, are in units of microns (1.0 μm). It should be observed, for FED 10, with no focusing means, that the electron beam broadens to a total cross-section of more than 100 microns at a transit distance of 1000 microns from electron emitter 13 and to a total cross-section of more than 180 microns at a transit distance of 3000 microns. In many applications it is desirable to minimize/reduce the total cross-section of the electron beam. Further, in many applications the anode will be disposed at distances of 1000–10,000 microns from the electron emitter (s) .

Figure 2A:
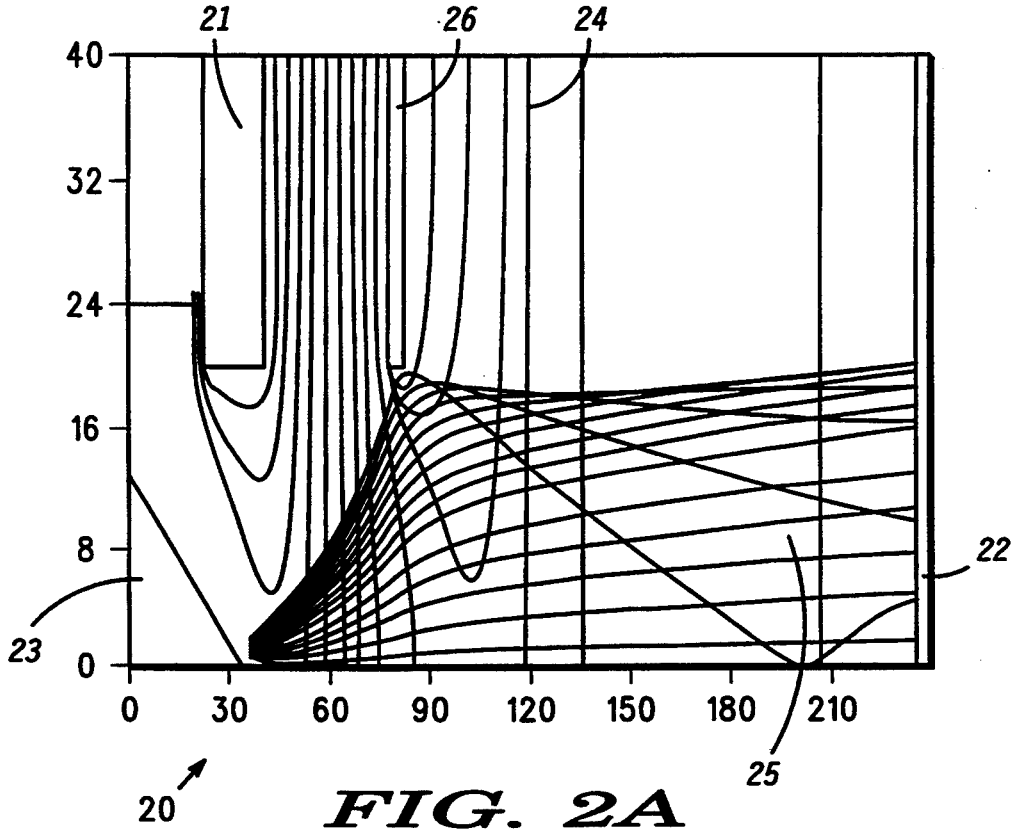
FIG. 2A is a computer model representation of a field emission device as is known in the prior art and further depicting emitted electron trajectories.

FIG. 2A is a computer model representation of one half of a side elevational view of a prior art FED 20 having an electron emitter 23, an anode 22 and a gate 21, all of which operate generally as described previously with reference to FIG. 1A. FED 20 is further comprised of an electrostatic lens 26 defining a central aperture therethrough having a diameter substantially the same as that of the central aperture of gate 21. As depicted in FIG. 2A, incorporation of lens 26 with a suitable externally provided potential applied thereto results in modification of electron trajectories 25.

Figure 2B:
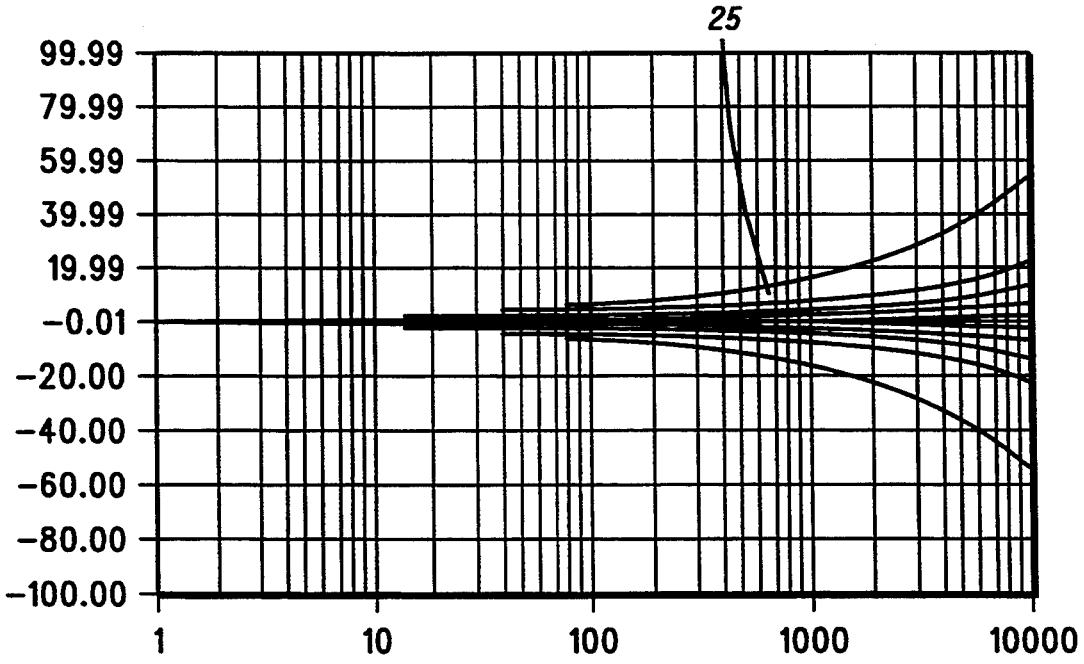
FIG. 2B is a depiction of an extension of the electron trajectories first described in FIG. 2A.

Referring now to FIG. 2B, a computer model representation of an extended electron path is illustrated which depicts electron trajectories 25 of FED 20, through a transit distance of 0.01 meter wherein electron trajectories 25 originate at the location depicted as 1.0 micron (ordinate) and −0.01 micron (abscissa). It should be observed, for FED 20, that the electron beam broadens to a total cross-section of more than 35 microns at a transit distance of 1000 microns from the electron emitter and to a total cross-section of more than 60 microns at a transit distance of 3000 microns.

The objectionable electron beam spread in FED 20 is due primarily to aberrations induced by the geometry and disposition of electrostatic lens 26. This prior art realization, in order to reduce the beam spread of nearly paraxial electron trajectories, overcorrects for electrons travelling in larger angle trajectories. As such, some of the electrons in the electron beam are overfocussed and contribute to broadening of the electron beam cross-section. This aberration of electrostatic lens 26 is due, at least in part, to a requirement that lens 26 be very thin.

Figure 3A:
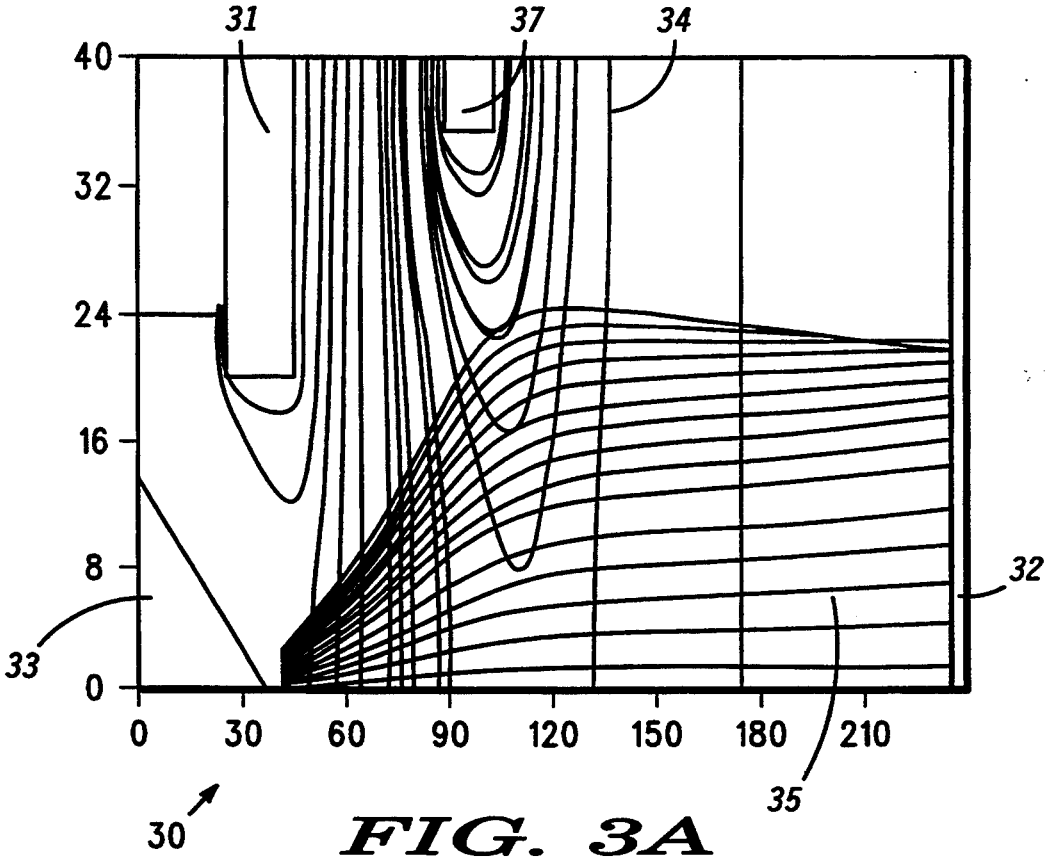
FIG. 3A is a computer model representation of a field emission device constructed in accordance with the present invention and further depicting emitted electron trajectories.

FIG. 3A is a computer model representation of one half of a side elevational view of an FED 30 including an electron emitter 33, an anode 32 and a gate 31, all of which operate generally as described previously with reference to FIG. 1A. FED 30 further includes an electrostatic lens 37 in accordance with the present invention. As depicted in FIG. 3A, incorporation of lens 37 with a suitable externally provided potential applied thereto results in modification of electron trajectories 35. Electrostatic lens 37 is distinguished from prior art lenses in that a central aperture defined therethrough has a diameter dis-similar from that of a central aperture through gate 31. In the case of FED 30 the differential diameter, that is the increase in diameter of the aperture through electrostatic lens 37 over the diameter of the aperture through gate 31, is 2600Å. Other embodiments may employ electrostatic lens structures with differential diameters on the order of 1000Å to more than 5000Å.

Realization of an FED wherein an electrostatic lens is formed in accordance with the present invention provides for relaxation of a number of constraints imposed on electrostatic lenses of the prior art.

Firstly, the electrostatic lens of the present invention may be thicker than prior art lenses. Operational sensitivities are reduced as variations in lens thickness caused by variations in the fabrication process is a smaller percentage of the overall lens thickness for the lens of the FED of the present invention. For example, a practical thickness for an electrostatic lens of the prior art is 1000Å whereas a practical thickness for a lens of an FED of the present invention may be in the range of 3000Å to more than 10,000Å. Accordingly, fabrication process variations which result in a deviation from the nominal thickness by 200Å corresponds to a 20% variation in the prior art lens of the present example whereas an identical fabrication process variation to the lens employed in an FED of the present invention may be as little as 2% (for a lens of 10,000Å thickness).

Secondly, an FED employing an electrostatic lens formed in accordance with the present invention is more distally disposed with respect to the electron emitter than are the electrostatic lenses known in the prior art and for that reason has a diminished influence on the electric field which is induced at/near the surface of the electron emitter. Recall that it is necessary for proper device operation to induce a strong electric field at the region of the electron emitter surface and that the electric field is substantially induced by applying a suitable voltage to the gate electrode. In FEDs employing electrostatic lenses the voltage applied to the lens is lower than that which is applied to the gate electrode and effectively reduces the maximum electric field which is induced at/near the surface of the electron emitter. Disposing the electrostatic lens more distally by providing a lens with a central aperture having a diameter which is greater than that of the diameter of the aperture of the gate electrode diminishes the effect which the electrostatic lens has on the induced electric field.

Thirdly, an FED employing an electrostatic lens in accordance with the present invention provides a significant reduction in lens aberration which results in an electron beam cross-section that is not overfocussed.

Fourthly, an FED employing an electrostatic lens in accordance with the present invention may be more distally disposed with respect to the gate electrode than is practical with prior art lenses. This increased flexibility diminishes the concern of voltage breakdown between the gate electrode and electrostatic lens.

Figure 3B:
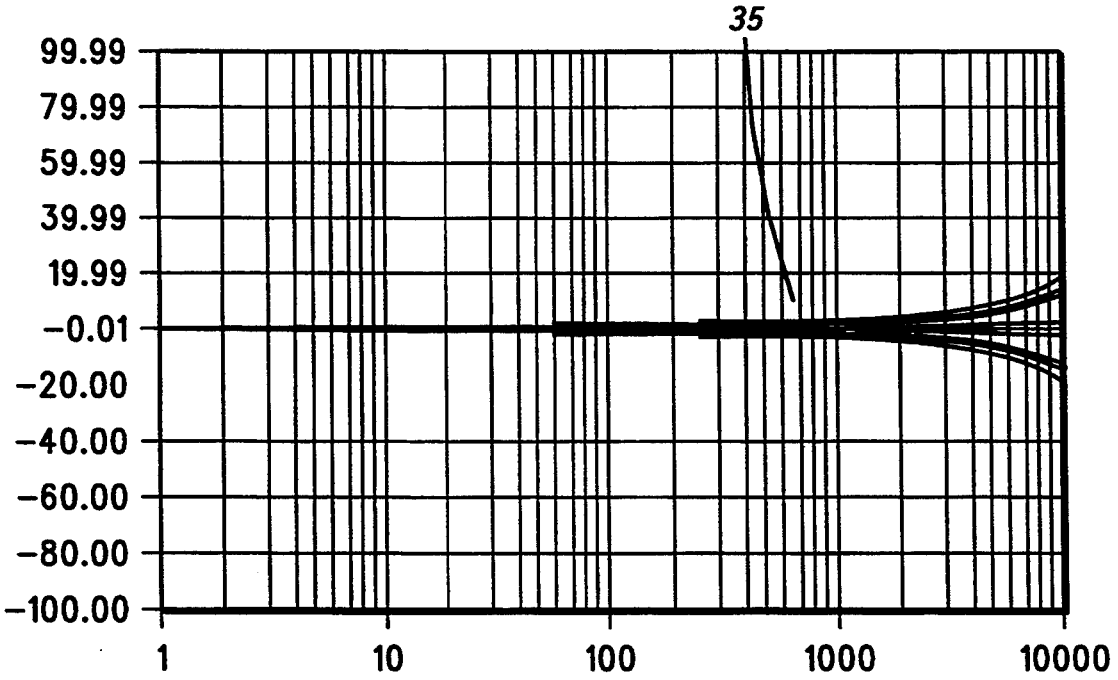
FIG. 3B is a depiction of an extension of the electron trajectories first described in FIG. 3A.

Referring now to FIG. 3B, a computer model representation of an extended electron path is illustrated which depicts electron trajectories 35 of FED 30 through a transit distance of 0.01 meter, wherein electron trajectories 35 originate at the location depicted as 1.0 micron (ordinate) and -0.01 micron (abscissa). It is observed, for FED 30, employing electrostatic lens 37 in accordance with the present invention, that the electron beam broadens to a total cross-section of less than approximately 10 microns at a transit distance on the order of 1000 microns from electron emitter 33 and to a total cross-section of less than approximately 16 microns at a transit distance on the order of 3000 microns.

It is one object of the present invention to provide an FED with an integrally formed electrostatic lens as a means of minimizing the emitted electron beam cross-section. An FED so constructed may be employed in a first of many possible applications as an electron source for an image display device exhibiting very high resolution and having individual pixel cross-sections on the order of approximately 2.0 to 25.0 μm. In the instance of an image device application the FED anode may include a substantially optically transparent faceplate having a surface on which is disposed at least a layer of cathodoluminescent material and at least a layer of substantially conductive material disposed on the layer of cathodoluminescent material such that any emitted electrons will excite the layer of cathodoluminescent material in a manner which induces photon emission.

FIGS. 4A through 4F are side elevational cross-sectional depictions of structures realized by performing various steps of a method of forming an embodiment of an FED with an integral electrostatic lens in accordance with the present invention.

Figure 4A:
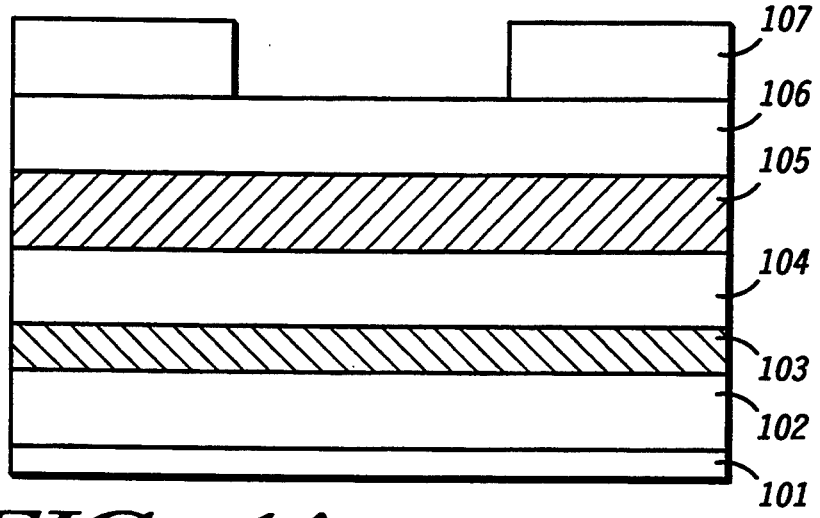
FIGS. 4A–4F are side elevational cross-sectional depictions of various structures each realized by performing at least some of the steps of a method of forming an embodiment of a field emission device in accordance with the present invention.

The structure depicted in FIG. 4A includes a supporting substrate 101, a first insulator layer 102, a first conductive/semiconductive layer 103, a second insulator layer 104, a second conductive/semiconductive layer 105, a third insulator layer 106, and a selectively patterned etch mask layer 107, all proximally disposed with respect to each other in a fixed relationship to form a single multi-layered structure wherein each layer is disposed substantially planar parallel with respect to any preceding and succeeding layers.

Figure 4B:
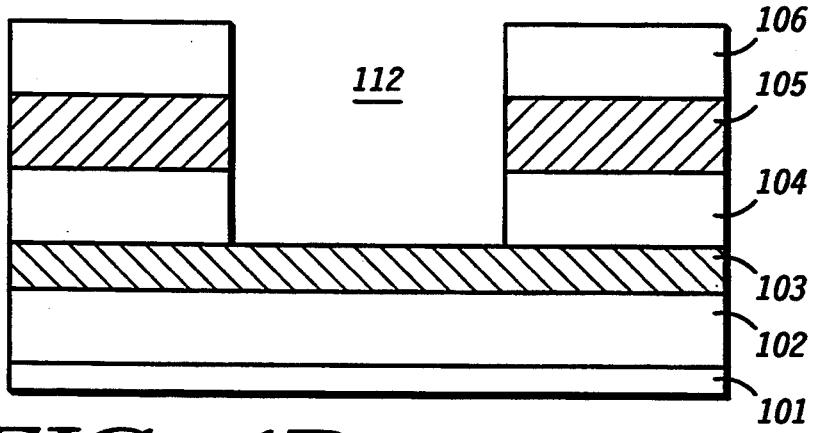

FIG. 4B is a structure formed as described previously with reference to FIG. 4A and having undergone additional process steps of the method to form an FED in accordance with the present invention wherein a first directed etch step is performed to remove some of each of third insulator layer 106, second conductive/semiconductive layer 105, and second insulator layer 104 in a region 112 substantially conforming to the pattern defined by selectively patterned etch mask layer 107 described previously with reference to FIG. 4A. FIG. 4B further depicts that selectively patterned etch mask 107 has been subsequently removed.

Figure 4C:
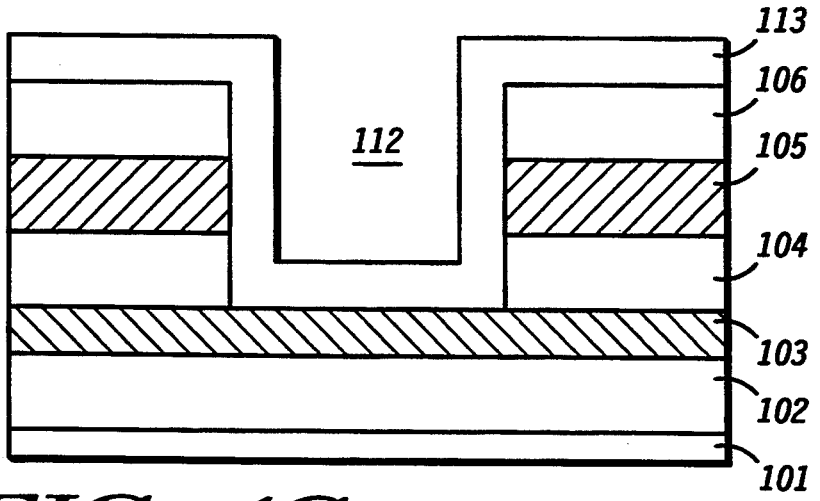
Figure 4D:
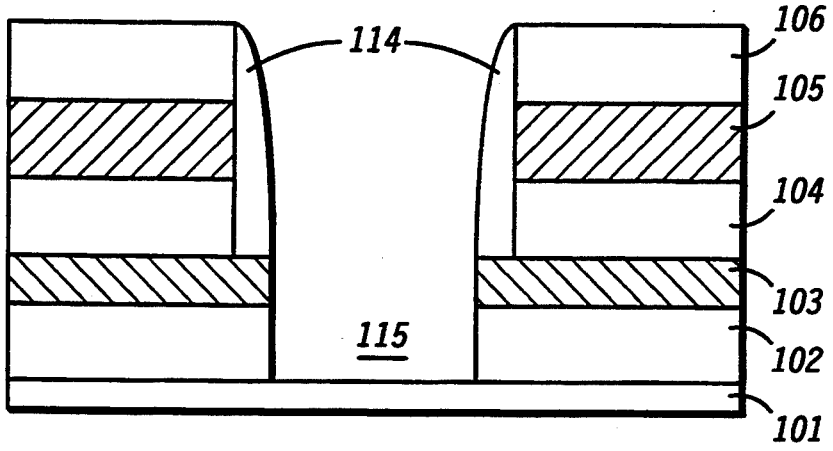
Figure 4E:
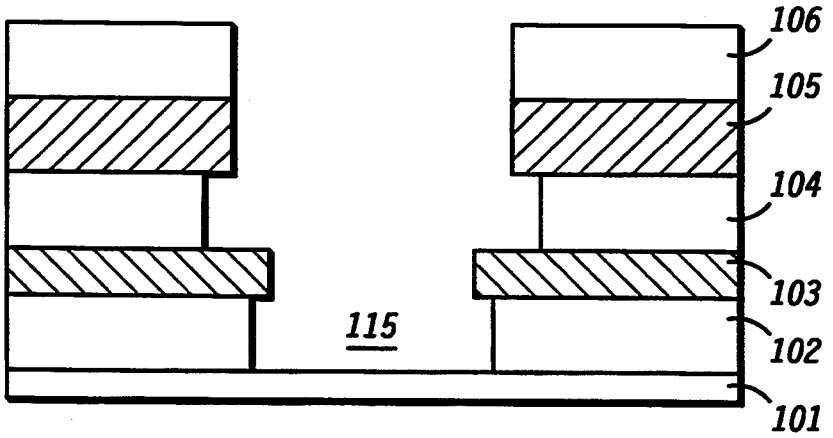
Figure 4F:
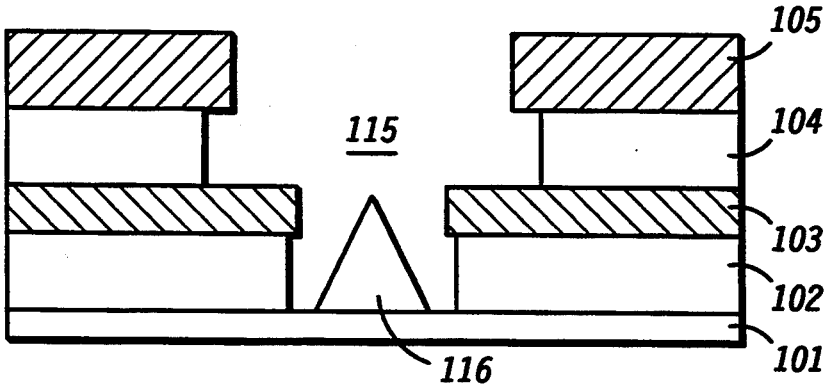

FIG. 4C illustrates a fourth insulator layer 113 conformally deposited onto the structure of FIG. 4B. In FIG. 4D a second directed etch is performed to remove a part of the material of fourth insulator layer 113 such that a sidewall 114 is formed. A third directed etch is performed such that some of the material of each of first conductive/semiconductive layer 103 and first insulator layer 102 is removed at a region 115 to the extent that some of the surface of supporting substrate 101 is exposed within region 115. FIG. 4E illustrates a step wherein substantially all of sidewall 114 is removed and wherein a part of each of first and second insulators 102, 104 is selectively removed. FIG. 4F illustrates a step wherein an electron emitter 116 is deposited within region 115 by any of the many commonly known methods such as, for example, by normal incidence evaporation techniques.

An FED constructed in accordance with the method detailed and described with reference to FIGS. 4A–4F is formed with an electrostatic lens, including second conductive/semiconductive layer 105, exhibiting an inner size greater than that of the gate, which includes first conductive/semiconductive layer 103. In general the inner size of the gate and the electrostatic lenses are referred to herein as a diameter but it should be understood that in special circumstances apertures other than round may be formed and it is intended to include all such embodiments herein. The differential inner diameter of the electrostatic lens with respect to the gate electrode is determined by the thickness of conformally deposited fourth insulator layer 113 from which sidewall 115 is subsequently formed.

FIGS. 5A through 5F are side elevational cross-sectional depictions of structures realized by performing various steps of a method of forming another embodiment of an FED with an integral electrostatic lens system in accordance with the present invention.

Figure 5A:
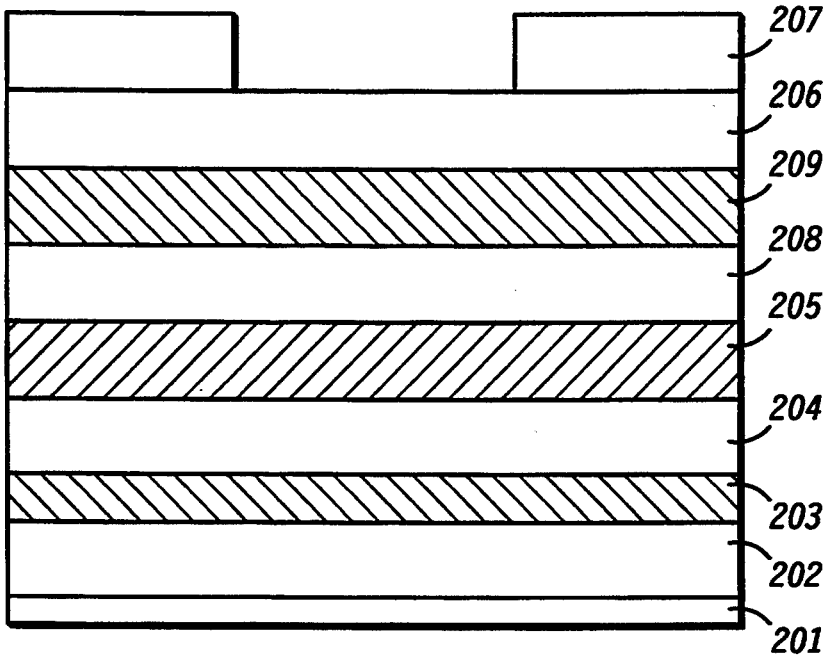
FIGS. 5A–5F are side elevational cross-sectional depictions of various structures each realized by performing at least some of the steps of a method of forming another embodiment of a field emission device in accordance with the present invention.

Referring now to FIG. 5A there is depicted a structure similar to that described previously with reference to FIG. 4A with similar parts being designated with similar numbers having a "2" prefix to indicate a different embodiment. The structure of FIG. 5A further includes a third insulator layer 208, deposited on conductive/semiconductive layer 205, and a third conductive/semiconductive layer 209 deposited on insulator layer 208, between layers 205 and 206, in accordance with another method of forming an FED of the present invention.

Figure 5B:
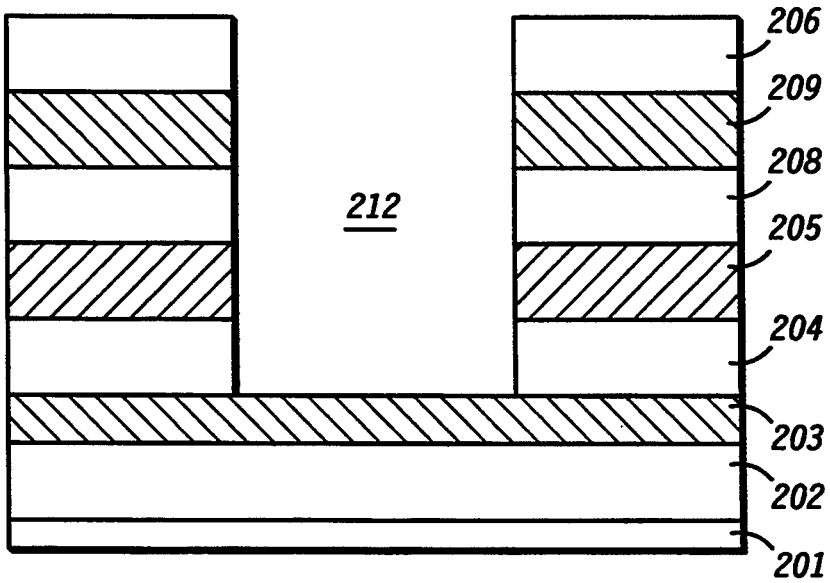
Figure 5C:
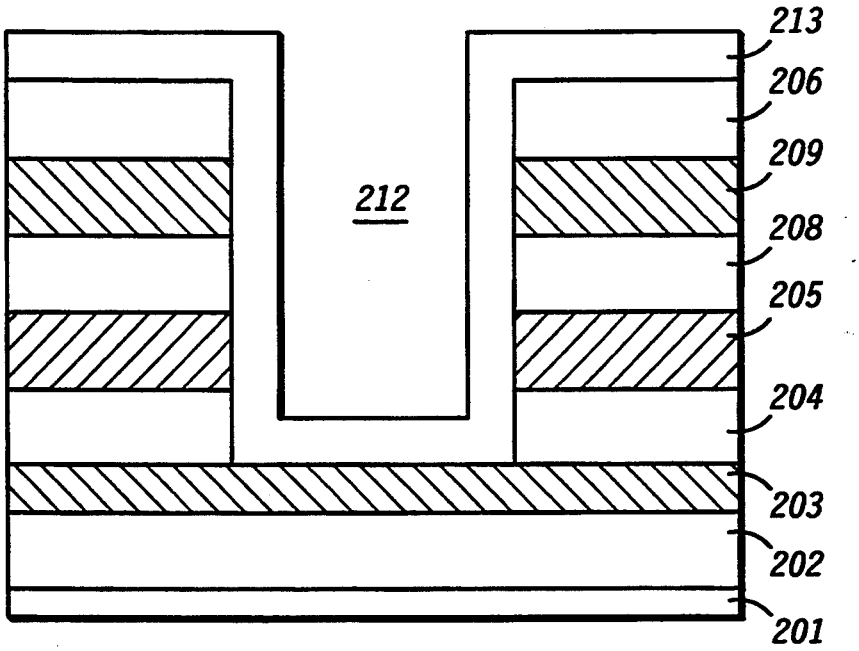
Figure 5D:
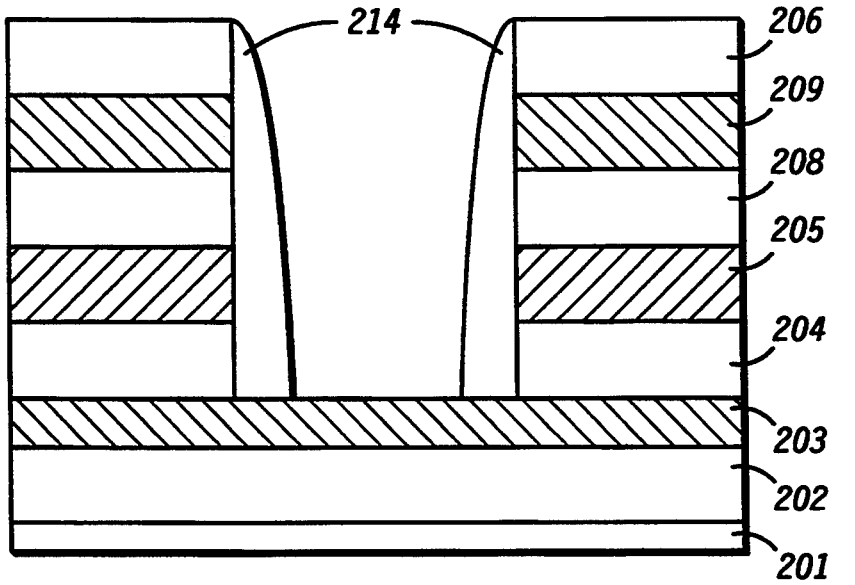
Figure 5E:
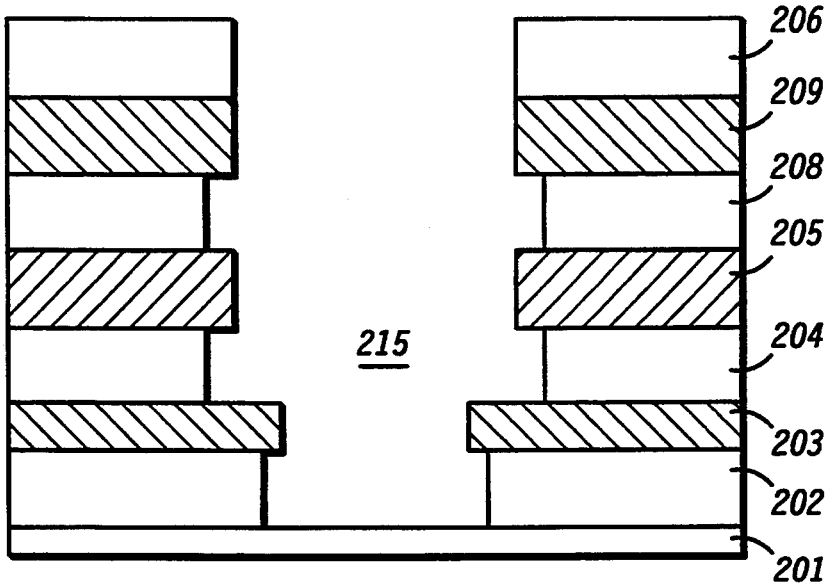
Figure 5F:
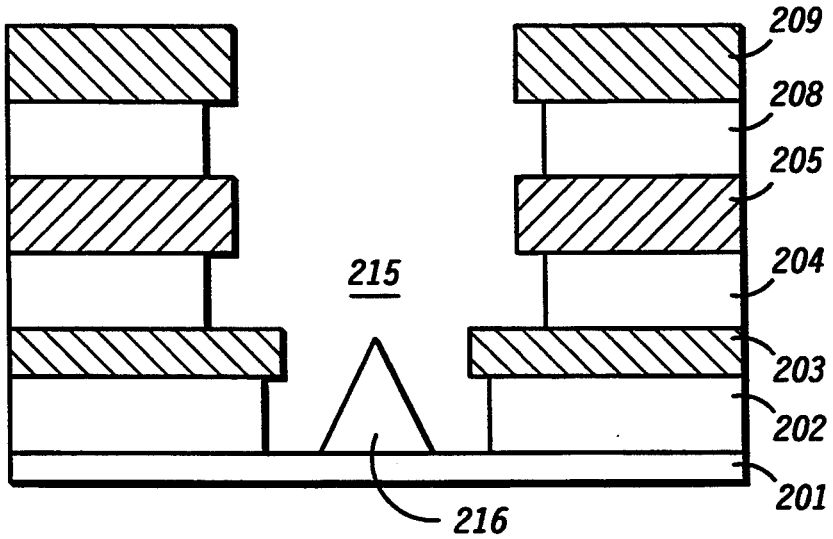

FIG. 5B illustrates an additional process step wherein a first directed etch is performed as described previously with reference to FIG. 4B and wherein the directed etch further removes some of the material of each of third conductive/semiconductive layer 209 and third insulator layer 208 in a region 212 substantially conforming to the pattern defined by selectively patterned etch mask layer 207. FIG. 4B further depicts that selectively patterned etch mask 207 has been subsequently removed. FIG. 5C illustrates an additional process step wherein a fifth insulator layer 213 has been conformally deposited onto the structure. FIG. 5D illustrates an additional process step, described previously with reference to FIG. 4D, such that a sidewall 214 is formed. FIG. 5E illustrates additional process steps similar to those described with reference to FIG. 4E and having formed therein a region 215 and further including that some of the material of third insulator layer 208 is selectively removed. FIG. 5F illustrates additional process steps as described previously with reference to FIG. 4F such that an electron emitter 216 is formed within region 215.

The FED of the present invention formed in accordance with the method described above with reference to FIGS. 5A–5F includes two integrally formed electrostatic lens electrodes each of which exhibits an inner diameter which is greater than the inner diameter of the gate electrode of the FED. As has been described previously the differential diameter of the electrostatic lens system with reference to the diameter of the gate electrode is a function of the thickness of the previously deposited conformal insulator layer.

Figure 6A:
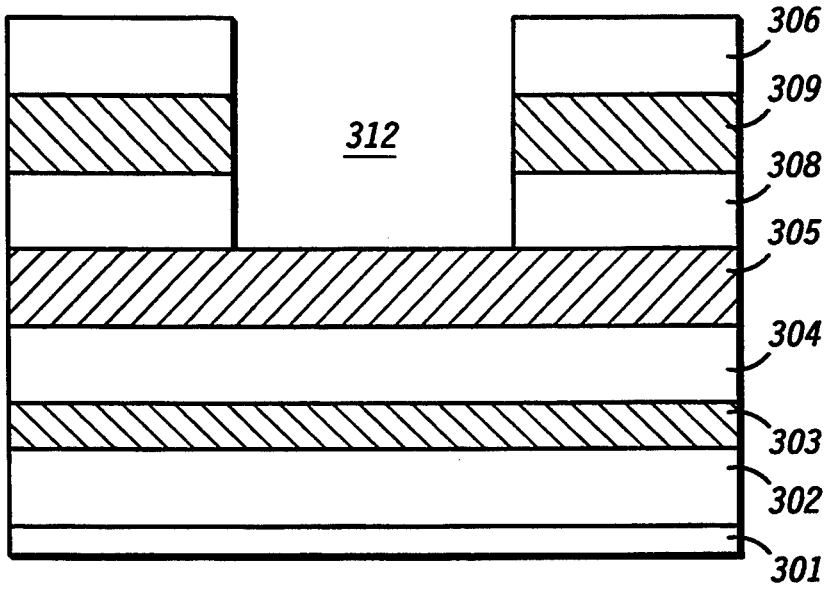
FIGS. 6A–6E are side elevational cross-sectional depictions of various structures each realized by performing at least some of the steps of a method of forming another embodiment of a field emission device in accordance with the present invention.
Figure 6B:
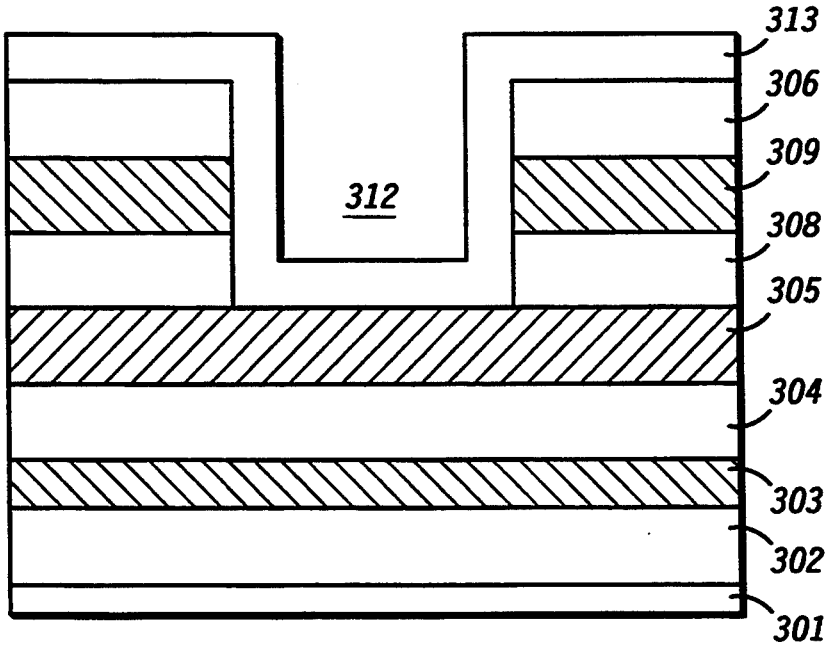
Figure 6C:
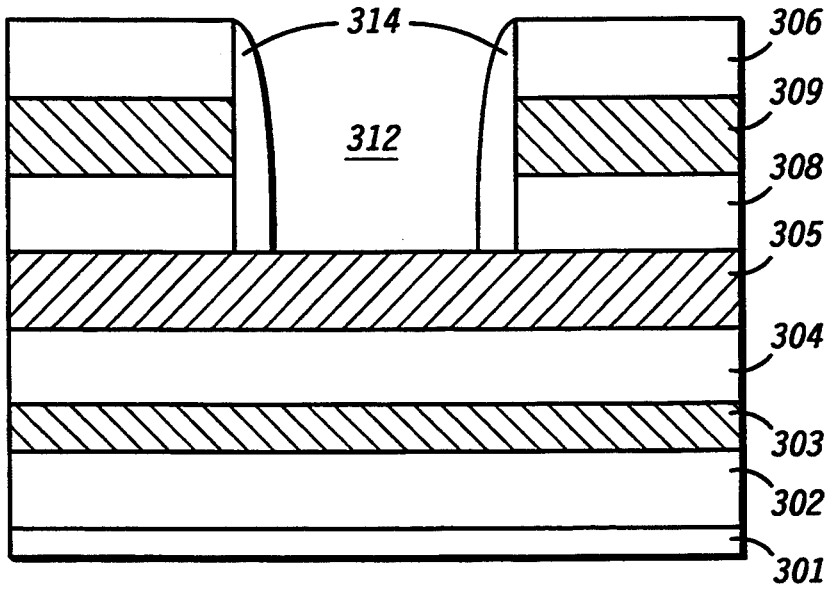
Figure 6D:
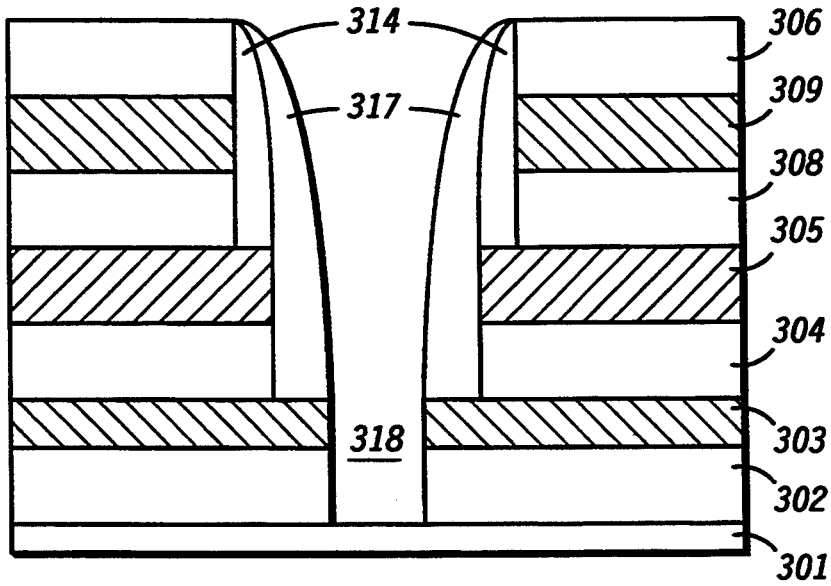
Figure 6E:
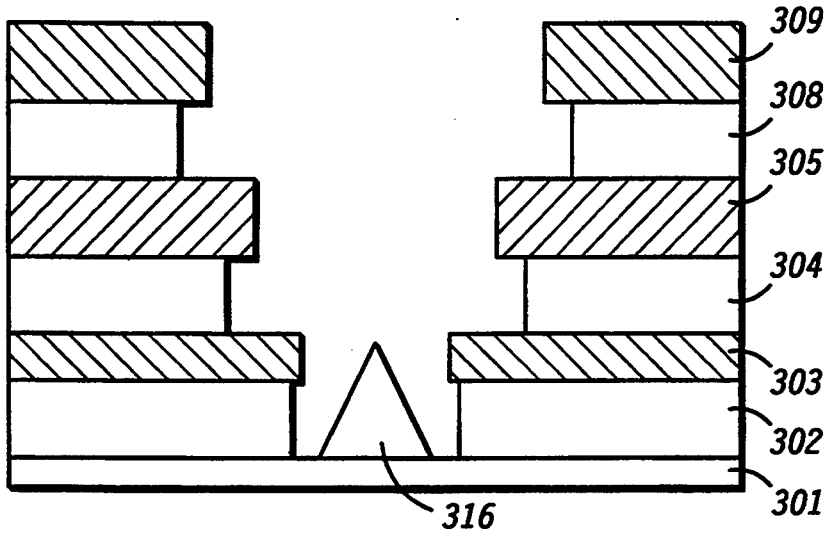

FIGS. 6A through 6E are side elevational cross-sectional depictions of structures realized by performing various steps of another method of forming an embodiment of an FED with an integral electrostatic lens system in accordance with the present invention. Referring now to FIG. 6A there is depicted a structure formed as described previously with reference to FIG. 5A with similar parts having similar numbers and a "3" prefix to denote another embodiment. In FIG. 6A a first region 312 is formed by selectively removing some of the material of each of a fourth insulator layer 306, a third conductive/semiconductive layer 309, and a third insulator layer 308 by a process step as described previously with reference to FIG. 5B and in accordance with another method of forming an FED of the present invention. FIG. 6B illustrates an additional process step wherein a fourth substantially conformal insulator layer 313 is deposited onto the structure. FIG. 6C illustrates an additional process step as described previously with reference to FIG. 4D such that a first sidewall 314 is formed. FIG. 6D illustrates additional process steps as described previously with reference to FIGS. 5B–5D and FIG. 4D such that a second sidewall 317 and a second region 318 are formed therein. FIG. 6E illustrates additional process steps as described previously with reference to FIGS. 5E & 5F such that an electron emitter 316 is disposed substantially within the second region 318.

The FED of the present invention employing an electrostatic lens system formed in accordance with the method as described above with reference to FIGS. 6A through 6E realizes a plurality of electrostatic lenses each with dis-similar diameters with reference to each other electrostatic lens of the system of lenses and each with a diameter dis-similar to the diameter of the gate electrode of the FED. An object of forming an FED with a lens system employing a plurality of electrostatic lenses of dis-similar diameters is to provide a means of multiply modifying the trajectories of emitted electrons which comprise the electron beam of a functioning device.

Figure 7:
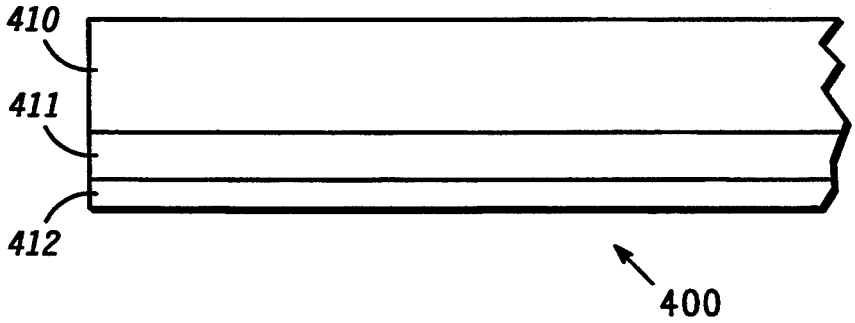
FIG. 7 is a side elevational cross-sectional depiction of a first image display device anode.

Referring now to FIG. 7 there is shown a commonly employed structure for realizing a first image display device anode 400 which includes a substantially optically transparent faceplate 410 having a major surface on which is disposed a layer of cathodoluminescent material 411 with a substantially conductive layer 412 disposed on the surface of material 411. In FEDs commonly employing display anode 400, at least some emitted electrons first pass through conductive layer 412 and impart at least some energy to cathodoluminescent material 411 to induce photon emission which may be viewed by an observer.

Figure 8:
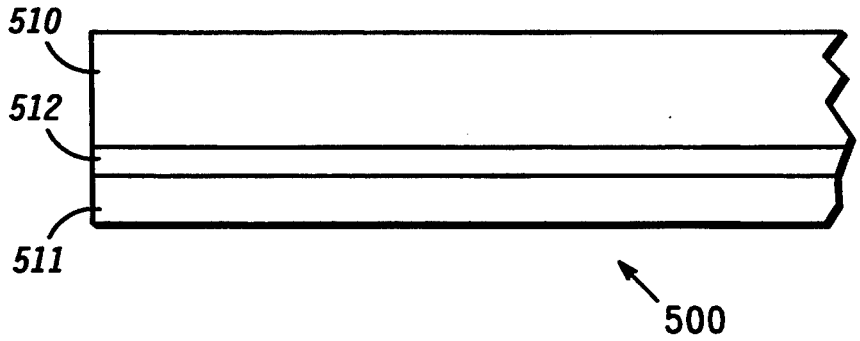
FIG. 8 is a side elevational cross-sectional depiction of a second image display device anode.

FIG. 8 depicts an alternative realization of a second image display device anode 500 which includes a substantially optically transparent faceplate 510 having a major surface on which is disposed a layer of substantially optically transparent conductive material 512 having disposed thereon a layer of cathodoluminescent material 511. In FEDs commonly employing display anode 500 at least some emitted electrons impart at least some energy to cathodoluminescent material 511, as they transit the thickness of the layer, to induce photon emission which may be viewed by an observer, which electrons are subsequently collected at conductive layer 512.

It is anticipated that by employing combinations of steps of each of the detailed methods and that by employing other process steps of alternative methods not specifically detailed in this disclosure that additional embodiments of FEDs employing electrostatic lens systems wherein the lens may be of a diameter dis-similar to that of the gate electrode may be realized. Further, by incorporating a display anode, as described above, the highly controllable FEDs provide a very useful, small and controllable display device.

While we have shown and described specific embodiments of the present invention, further modifications and improvements will occur to those skilled in the art. We desire it to be understood, therefore, that this invention is not limited to the particular forms shown and we intend in the append claims to cover all modifications that do not depart from the spirit and scope of this invention.

What we claim is:

1. A field emission device comprising an electron emitter for emitting electrons, a gate defining an aperture therethrough, with a first size, through which emitted electrons pass, the gate being designed to have a voltage applied thereto which induces an electric field at the electron emitter for causing electron emission, an anode positioned to collect emitted electrons passing through the gate aperture, and an electrostatic lens positioned between the gate and the anode and defining an aperture therethrough for the passage of emitted electrons, the aperture of the electrostatic lens having a second size which is greater than the first size of the aperture of the gate and which is positioned generally coaxially with respect to the aperture of the gate, and the electrostatic lens being designed to have a voltage applied thereto for modifying trajectories of electrons emitted by the electron emitter with a minimum effect on the induced electric field at the electron emitter.

2. The field emission device of claim 1 wherein the electrostatic lens is constructed to provide an emitted electron beam cross-section of less than approximately 10 microns measured at a distance on the order of 1000 microns from the electron emitter.

3. The field emission device of claim 1 wherein the electrostatic lens is constructed to provide an emitted electron beam cross-section of less than approximately 25 microns measured at a distance on the order of 3000 microns from the electron emitter.

4. The field emission device of claim 1 wherein the anode includes:

a substantially optically transparent faceplate;

a layer of cathodoluminescent material disposed on a surface of the faceplate; and a layer of substantially conductive material disposed on the cathodoluminescent layer.

5. The field emission device of claim 1 wherein the size of the aperture through the electrostatic lens is on the order of 1000Å greater than the size of the aperture through the gate.

6. A field emission device comprising:

an electron emitter for emitting electrons;

a gate positioned adjacent the electron emitter and defining an aperture, having a first diameter, through which emitted electrons may pass;

an anode positioned to collect emitted electrons, the gate being designed to have a voltage applied thereto which induces an electric field at the electron emitter for causing electron emission;

a first electrostatic lens positioned between the gate and the anode and defining an aperture therethrough for the passage of electrons, the aperture of the first electrostatic lens having a second diameter which is greater than the first diameter of the aperture of the gate and which is positioned generally coaxially with respect to the aperture in the gate, and the electrostatic lens being designed to have a voltage applied thereto for modifying trajectories of electrons emitted by the electron emitter with a minimum effect on the induced electric field at the electron emitter; and a second electrostatic lens positioned between the gate and the anode and spaced from the first electrostatic lens, the second electrostatic lens defining an aperture therethrough for the passage of electrons, and the aperture of the second electrostatic lens having a third diameter which is dis-similar to that of the second diameter of the aperture of the first electrostatic lens and the first diameter of the aperture of the gate and which is positioned generally coaxially with respect to the apertures in the gate and in the first electrostatic lens.

7. The field emission device of claim 6 wherein the first and second electrostatic lenses are constructed to provide an emitted electron beam cross-section of less than approximately 10 microns measured at a distance on the order of 1000 microns from the electron emitter.

8. The field emission device of claim 6 wherein the first and second electrostatic lenses are constructed to provide an emitted electron beam cross-section of less than approximately 25 microns measured at a distance on the order of 3000 microns from the electron emitter.

9. The field emission device of claim 6 wherein the anode includes:

a substantially optically transparent faceplate;

a layer of cathodoluminescent material disposed on a surface of the faceplate; and a layer of substantially conductive material disposed on the cathodoluminescent layer.

10. The field emission device of claim 6 wherein the second and third diameters of the apertures of each of the first and second electrostatic lenses are on the order of 1000Å greater than the first diameter of the aperture of the gate.

11. An image display device comprising:

an electron emitter for emitting electrons;

a gate positioned adjacent the electron emitter and defining an aperture through which emitted electrons pass, the aperture of the gate having a first diameter, the gate being designed to have a voltage applied thereto which induces an electric field at the electron emitter for causing electron emission;

an anode positioned to collect some emitted electrons, the anode including a substantially optically transparent faceplate, a first layer of cathodoluminescent material disposed on a surface of the faceplate, and a layer of substantially conductive material disposed on the layer of cathodoluminescent material; and an electrostatic lens positioned between the electron emitter and the anode for modifying the trajectories of emitted electrons, the electrostatic lens defining an aperture having a diameter which is larger with respect to the diameter of the aperture in the gate and which is positioned generally coaxially with respect to the aperture in the gate, and the electrostatic lens being designed to have a voltage applied thereto for modifying trajectories of electrons emitted by the electron emitter with a minimum effect on the induced electric field at the electron emitter.

12. The image display device of claim 11 wherein the diameter of the aperture of the electrostatic lens is on the order of 1000Å to 5000Å greater than the diameter of the aperture of the gate.

13. The image display device of claim 11 wherein the modified electron beam trajectories provide for a pixel cross-section of less than approximately 10 microns at a distance on the order of 1000 microns from the electron emitter.

14. The image display device of claim 13 wherein the modified electron beam trajectories provide for a pixel cross-section of less than approximately 20 microns at a distance on the order of 3000 microns from the electron emitter.

* * * * *